US010222104B2

(12) United States Patent
Kang et al.

(10) Patent No.: US 10,222,104 B2
(45) Date of Patent: Mar. 5, 2019

(54) DISTRIBUTOR AND TURBO REFRIGERATING MACHINE AND EVAPORATOR HAVING THE SAME

(71) Applicant: LG ELECTRONICS INC., Seoul (KR)

(72) Inventors: Jungho Kang, Seoul (KR); Cheolmin Kim, Seoul (KR); Simbok Ha, Seoul (KR); Jinhee Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 484 days.

(21) Appl. No.: 14/531,802

(22) Filed: Nov. 3, 2014

(65) Prior Publication Data

US 2015/0168035 A1 Jun. 18, 2015

(30) Foreign Application Priority Data

Dec. 17, 2013 (KR) ..... 10-2013-0157088

(51) Int. Cl.
*F25B 39/02* (2006.01)
*F28D 21/00* (2006.01)

(52) U.S. Cl.
CPC ..... *F25B 39/028* (2013.01); *F25B 2400/23* (2013.01); *F28D 2021/0071* (2013.01)

(58) Field of Classification Search
CPC ..... F25B 39/028; F28D 2021/0071
See application file for complete search history.

(56) References Cited

U.S. PATENT DOCUMENTS 5,561,987 A 10/1996 Hartfield et al.
6,253,571 B1 * 7/2001 Fujii ..... F25B 15/008 62/484
6,572,687 B2 * 6/2003 Slaymaker ..... B01D 53/261 34/80
6,868,695 B1 3/2005 Dingel et al.
7,118,098 B2 * 10/2006 Thiel ..... B01D 3/20 203/71
8,408,026 B2 * 4/2013 Kovak ..... B01D 3/008 202/158
2009/0178790 A1 7/2009 Schreiber et al.
2011/0120181 A1 * 5/2011 De Larminat ..... F25B 39/028 62/515
2013/0277018 A1 10/2013 Numata et al.

FOREIGN PATENT DOCUMENTS

WO WO 2000-055552 A1 9/2000

OTHER PUBLICATIONS

European Search Report issued in Application No. 14194424.9 dated May 12, 2015.

* cited by examiner

*Primary Examiner* — Filip Zec
(74) *Attorney, Agent, or Firm* — Ked & Associates, LLP

(57) ABSTRACT

A distributor and an evaporator having the same are provided. The distributor may include a first refrigerant distributor provided with a plurality of through holes formed in a first direction, and a plurality of refrigerant dropping devices that guide refrigerant, dropped from the first refrigerant distributor through the plurality of through holes, to a heat transfer pipe, and having a sectional area of flow surfaces thereof that decreases in a flow direction of the refrigerant.

23 Claims, 13 Drawing Sheets

DISTRIBUTOR AND TURBO REFRIGERATING MACHINE AND EVAPORATOR HAVING THE SAME

CROSS-REFERENCE TO RELATED APPLICATION(S)

This application claims priority to Korean Patent Application No. 10-2013-0157088, filed in Korea on Dec. 17, 2013, which is hereby incorporated by reference as if fully set forth herein.

BACKGROUND

1. Field

A distributor and turbo refrigerating machine and evaporator having the same are disclosed herein.

2. Background

In general, a turbo refrigerating machine is an apparatus that performs heat exchange between chilled water and condensed water using a refrigerant, and includes a compressor, an evaporator, a condenser, and an expansion valve. The evaporator and the condenser may have a shell-in-tube structure. Chilled water and condensed water may, respectively, flow in tubes of the evaporator and the condenser, and the refrigerant may be received in the shells of the evaporator and the condenser. Further, the chilled water may be introduced into and discharged from the evaporator, heat exchange between the refrigerant and the chilled water may be performed in the evaporator, and the chilled water may be cooled during a process of passing through the evaporator.

If the evaporator is a falling film evaporator, a distributor to uniformly distribute refrigerant introduced into the evaporator to a heat transfer pipe in which chilled water flows may be provided. In order to uniformly distribute the refrigerant to the heat transfer pipe through the distributor, it is important to effectively control two-phase flow between liquid refrigerant and gaseous refrigerant introduced into the evaporator.

However, as a moving velocity of the refrigerant introduced into the evaporator is high, it may be difficult to uniformly distribute the refrigerant along the heat transfer pipe. Further, if a refrigerant mixture of gaseous refrigerant and liquid refrigerant is introduced into the evaporator and separation of the gaseous refrigerant and the liquid refrigerant from the refrigerant mixture is not efficiently carried out, the refrigerant may not be uniformly distributed due to a dynamic pressure difference of the two phase refrigerant and non-uniform dynamic pressure.

In the conventional distributor, the introduced refrigerant flows only to corners, and thus, the refrigerant may not be uniformly distributed to the heat transfer pipe, or the distributor is manufactured in a complex shape to achieve uniform refrigerant flow. Therefore, a distributor, which may effectively separate liquid refrigerant and gaseous refrigerant from refrigerant, introduced into an evaporator, and lower dynamic pressures of the liquid refrigerant and the gaseous refrigerant so as to easily control two-phase flow, has been required. Further, a distributor, which may uniformly distribute liquid refrigerant separated at an inside of an evaporator to a heat transfer pipe provided in the evaporator, has been required.

BRIEF DESCRIPTION OF THE DRAWINGS

Embodiments will be described in detail with reference to the following drawings in which like reference numerals refer to like elements, and wherein.

DETAILED DESCRIPTION

Figure 1:
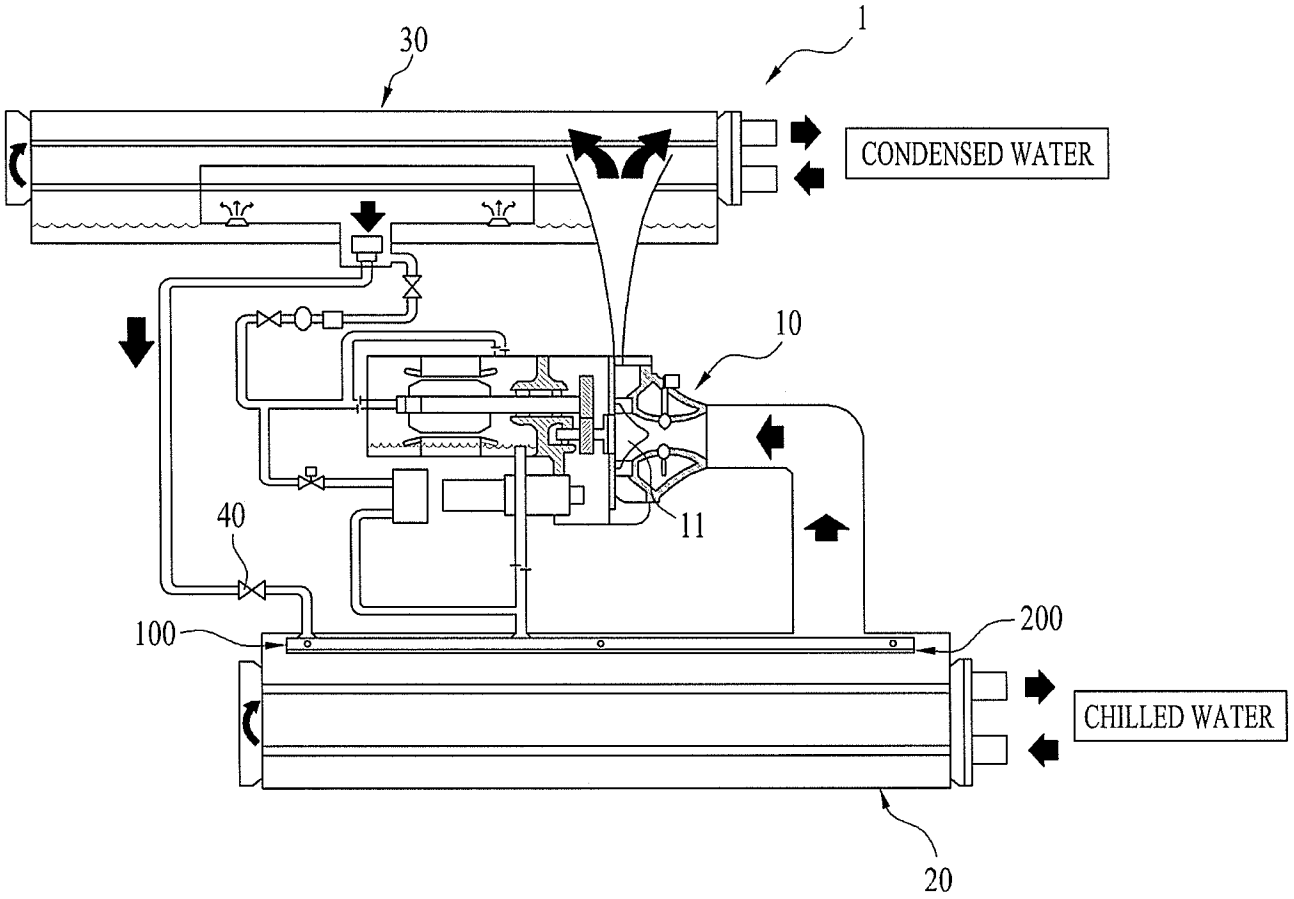
FIG. 1 is a schematic view of a turbo refrigerating machine in accordance with an embodiment.

Hereinafter, a distributor, an evaporator, and a turbo refrigerating machine having the same in accordance with embodiments will be described with reference to the accompanying drawings. Reference will now be made in detail to embodiments, examples of which are illustrated in the accompanying drawings.

Further, the same or similar elements are denoted by the same or similar reference numerals even though they are depicted in different drawings, and repetitive a detailed description thereof has thus been omitted. In the drawings, sizes or shapes of elements may be exaggerated or reduced for clarity and convenience of description. Furthermore, it will be understood that, although the terms first, second, etc. may be used herein to describe various elements, these elements should not be limited by these terms.

Hereinafter, a distributor and a turbo refrigerating machine and evaporator having the same in accordance with embodiments will be described in detail with reference to the accompanying drawings.

FIG. 1 is a schematic view of a turbo refrigerating machine in accordance with an embodiment. With reference to FIG. 1, a turbo refrigerating machine 1, to which an evaporator in accordance with an embodiment may be applied, may include a compressor 10 to compress refrigerant, a condenser 30, an expansion valve 40, and evaporator 20.

In more detail, the turbo refrigerating machine 1 may include the compressor 10, which may include an impeller 11 to compress refrigerant, and the condenser 30 to provide heat exchange between the refrigerant flowing from the compressor 10 and condensed water. The turbo refrigerating machine 1 may further include the evaporator 20 to provide heat exchange between the refrigerant discharged from the condenser 30 and chilled water, and the expansion valve 40 provided between the condenser 20 and the evaporator 20.

The compressor 10 may include a one-stage or two-stage compressor. The compressor 10 may include the impeller 11 rotated by a drive force of a drive motor to compress the refrigerant. The compressor 10 may further include a shroud, in which the impeller 11 may be accommodated, and a variable diffuser that converts kinetic energy of fluid discharged due to rotation of the impeller 11 into pressure energy.

FIG. 1 illustrates the compressor 10 including a one-stage compressor. However, embodiments are not limited thereto.

In accordance with one embodiment, the evaporator 20 and the condenser 30 may have a shell-in-tube structure. Chilled water and condensed water may, respectively, flow in the tubes of the evaporator 20 and the condenser 30, and refrigerant may be received to designated heights in the shells of the evaporator 20 and the condenser 30.

The chilled water may be introduced into and discharged from the evaporator 20, and heat exchange between refrigerant and the chilled water may be carried out within the evaporator 20, so that the chilled water introduced into the evaporator 20 may be cooled while passing through the evaporator 20. Further, condensed water may be introduced into and discharged from the condenser 30, and heat exchange between refrigerant and the condensed water may be carried out within the condenser 30, so that the condensed water may be heated while passing through the condenser 30.

As described above, the compressor 10 may include a two-stage compressor. In this case, the compressor 10 may be a multi-stage compressor having a plurality of stages.

In accordance with one embodiment, if the compressor 10 includes a two-stage compressor, the turbo refrigerating machine 1 may further include an economizer to separate liquid refrigerant and gaseous refrigerant from refrigerant discharged from the condenser 30 and to discharge the separated gaseous refrigerant to the compressor 10. Further, the turbo refrigerating machine 1 may include a first expansion valve provided between the condenser 30 and the economizer, and a second expansion valve provided between the economizer and the evaporator 20.

Also, if the compressor 10 includes the two-stage compressor, as described above, in accordance with one embodiment, the compressor 10 may include a low-pressure compressor and a high-pressure compressor. A one-stage impeller may be provided at the low-pressure compressor, a two-stage impeller may be provided at the high-pressure compressor. The refrigerant discharged from the evaporator 20 may be introduced into the low-pressure compressor, and the gaseous refrigerant separated by the economizer may be introduced into the high-pressure compressor.

Consequently, as both the gaseous refrigerant separated by the economizer and the refrigerant compressed by the low-pressure compressor, are compressed in the high-pressure compressor, a compression load applied to the compressor 10 may be reduced. As the compression load applied to the compressor 10 is reduced, an operating range of the compressor 10 may be increased.

Figure 2:
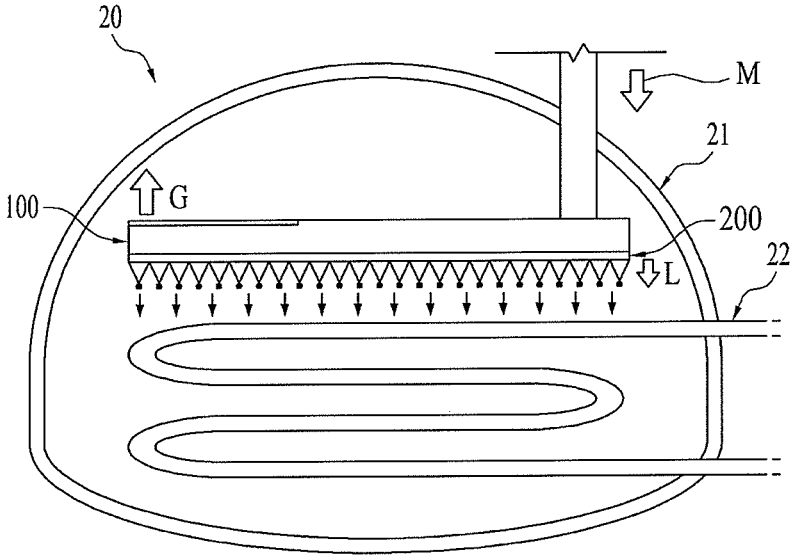
FIG. 2 is a schematic view illustrating an inside of an evaporator in accordance with an embodiment.

FIG. 2 is a conceptual view illustrating an inside of an evaporator in accordance with an embodiment. Although FIG. 2 exemplarily illustrates a falling film evaporator, a distributor and an evaporator having the same in accordance with embodiments are not limited thereto.

A refrigerant mixture M introduced into the evaporator 20 in accordance with embodiments may be uniformly distributed to a heat transfer pipe 22, in which chilled water may flow, through a distributor 200. In order to uniformly distribute the refrigerant mixture M to the heat transfer pipe 22 through the distributor 200, it is important to control two-phase flow of the refrigerant mixture M of liquid refrigerant L and gaseous refrigerant G introduced into the evaporator 20.

As a dynamic pressure of the refrigerant mixture M of liquid refrigerant L and gaseous refrigerant G flowing in the distributor 200 is not uniform, the refrigerant mixture M may not be uniformly distributed to the heat transfer pipe 22 by the distributor 200. Further, a velocity of the refrigerant mixture M introduced into the evaporator 20 may be high, and thus, the refrigerant mixture M may not be uniformly distributed by the distributor 200.

As described above, non-uniform refrigerant distribution may form dry spots in the heat transfer pipe 22, and such local dry spots may lower an overall heat exchange performance of the falling film evaporator. Therefore, the refrigerant mixture M flowing in the distributor 200 needs to be effectively separated into gaseous refrigerant G and liquid refrigerant L, and requires uniform maintenance of dynamic pressure of the refrigerant flowing in the distributor 200.

The evaporator 20 in accordance with one embodiment may be a falling film evaporator, as indicated above, and may have a shell-in-tube structure. Further, the heat transfer pipe 22, in which chilled water may flow, a gas-liquid separator 100, in which the refrigerant introduced into the evaporator 100 may flow, and the distributor 200 may be provided within a shell 21. Within the shell 21, the distributor 200 alone may be provided or the gas-liquid separator 100 and the distributor 200 may be provided.

Figure 3:
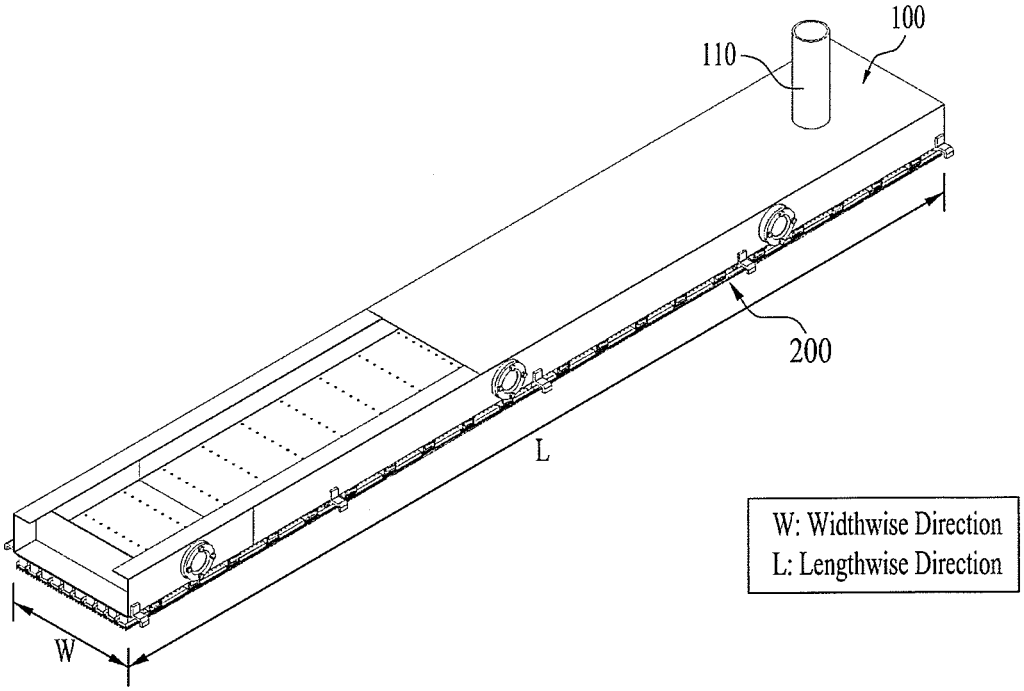
FIG. 3 is a perspective view of a gas-liquid separator and a distributor of the evaporator of FIG. 2.

FIG. 3 is a perspective view of a gas-liquid separator and distributor of the evaporator of FIG. 2. Hereinafter, the gas-liquid separator 100 and the distributor 200, which may be integrated with each other in the shell 21, will be described, as exemplarily shown in FIG. 3; however, embodiments are not limited thereto. Further, although the evaporator 20 including the integrated gas-liquid separator 100 and distributor 200 applied to the turbo refrigerating machine 1 will be exemplarily illustrated, embodiments are not limited thereto and may be variously applied to various air conditioners or other devices.

Hereinafter, the evaporator, and the gas-liquid separator and the distributor forming the evaporator in accordance with embodiments will be described in detail with reference to FIGS. 2 to 5.

Figure 4:
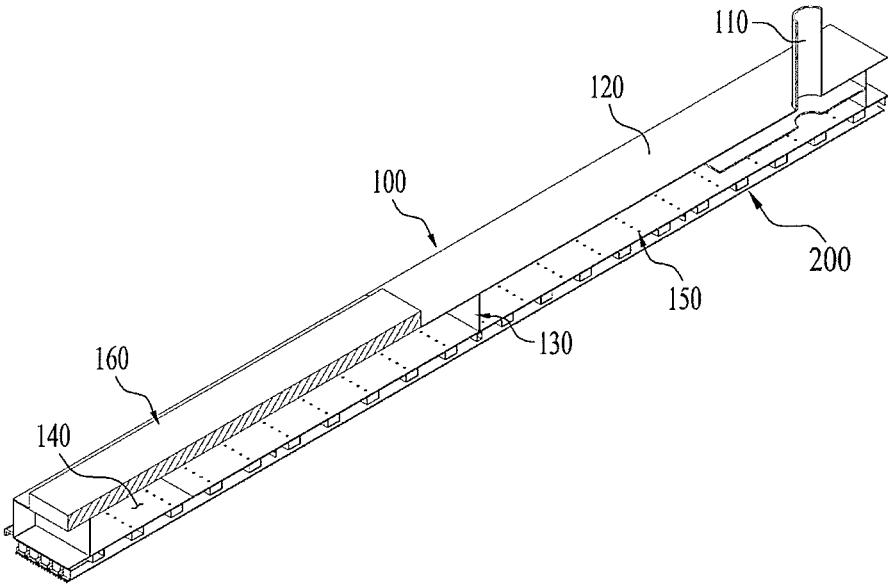
FIG. 4 is a longitudinal-sectional view of the gas-liquid separator and the distributor of FIG. 3.
Figure 5:
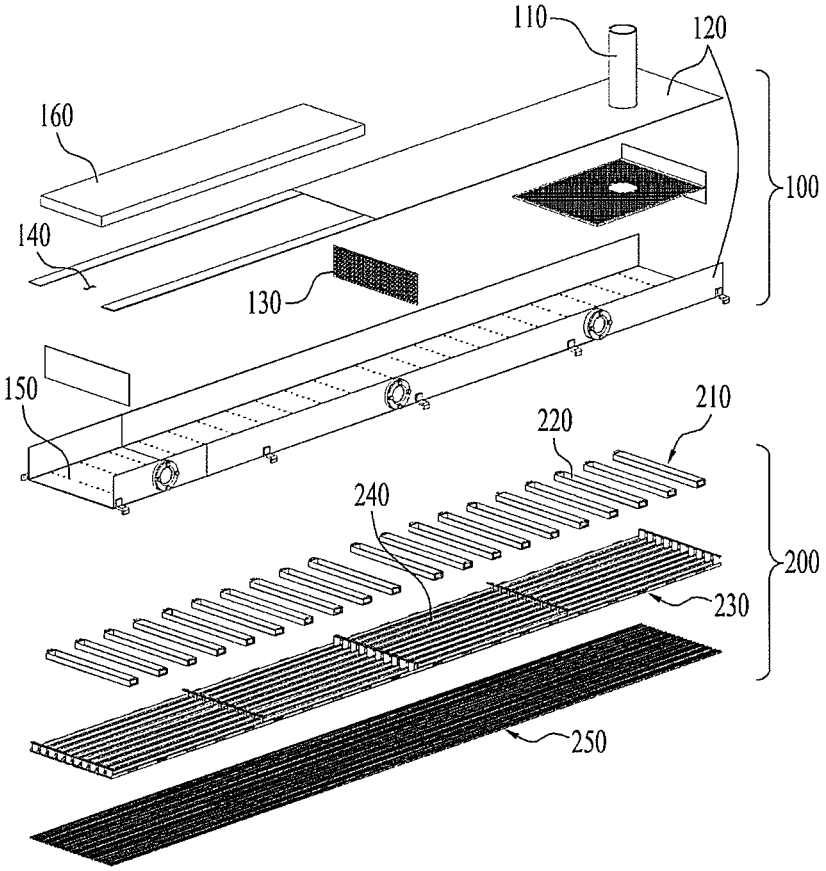
FIG. 5 is an exploded perspective view of the gas-liquid separator and the distributor of FIG. 3.

FIG. 3 is a perspective view of the gas-liquid separator and the distributor forming the evaporator of FIG. 2. FIGS. 4 and 5 are longitudinal-sectional and exploded perspective views of the gas-liquid separator and the distributor, respectively, of FIG. 3.

The evaporator 20 in accordance with embodiments may include the shell 21 forming an external appearance of the evaporator 20, and the gas-liquid separator 100 that separates gaseous refrigerant and liquid refrigerant from the refrigerant mixture introduced into a refrigerant inlet 110 of the evaporator 20. The distributor 200 may be provided under the gas-liquid separator 100. The evaporator 20 may uniformly distribute the liquid refrigerant to the heat transfer pipe 22, in which chilled water to exchange heat with the liquid refrigerant distributed by the distributor 200, may flow.

The evaporator 20 in accordance with embodiments may be a hybrid falling film evaporator, in which a portion of the liquid refrigerant distributed by the distributor 200 may be carried to a bottom of the shell 21, and a portion of the heat transfer pipe 22 may be submerged in a pool, in which the liquid refrigerant carried to the bottom of the shell 21 may be stored to a designated height.

The evaporator 20 in accordance with embodiments may include the gas-liquid separator 100 and the distributor 200, which may be integrated with each other in the shell 21. The integrated gas-liquid separator 100 and the distributor 200 may be advantageous in that the gas-liquid separator 100 may separate the gaseous refrigerant and the liquid refrigerant introduced into the evaporator 20 in a mixed state, and then, the distributor 200 may immediately distribute the liquid refrigerant to the heat transfer pipe 22.

The integrated gas-liquid separator 100 and the distributor 200 may extend corresponding in length and width to the heat transfer pipe 22 located therebelow. Thereby, the distributor 200 may uniformly distribute the liquid refrigerant in a lengthwise direction and widthwise direction of the heat transfer pipe 22.

The gas-liquid separator 100 may include a housing 120 including the refrigerant inlet 110, and a plurality of porous plates 130 that separates gaseous refrigerant and liquid refrigerant from a refrigerant mixture introduced through the refrigerant inlet 110. The housing 120 may include a gaseous refrigerant outlet 140, through which the separated gaseous refrigerant may be discharged from the housing 120, and a liquid refrigerant outlet 150, through which the separated liquid refrigerant may be discharged from the housing 120. The liquid refrigerant outlet 150 may include a plurality of through holes formed through a lower surface of the housing 120.

The gaseous refrigerant outlet 140 may be located at a first end of the housing 120, opposite to the refrigerant inlet 110, which may be located at a second end of the housing 120 in the lengthwise direction. The gaseous refrigerant discharged through the gaseous refrigerant outlet 140 may be introduced into the compressor 110.

An eliminator 160 may be provided above the gaseous refrigerant outlet 140, and thus, may prevent the liquid refrigerant from being introduced into the compressor 10. The eliminator 160 may include a plurality metal nets stacked to perform a function of filtering the liquid refrigerant discharged together with the gaseous refrigerant.

The eliminator 160 may extend toward the refrigerant inlet 110 a designated length in the lengthwise direction from the first end of the housing 120, opposite to the refrigerant inlet 110 located at the second end of the housing 120 in the lengthwise direction. The eliminator 160 may be designed such that a size of the eliminator 160 corresponds to a dryness and flow rate of the refrigerant.

The plurality of porous plates 130 may be provided, each of which may be provided with a plurality of holes to pass fluid there through. The plurality of porous plates 130 may be separated from each other by a designated interval in the lengthwise direction of the housing 120 and may be provided within the housing 120.

The plurality of porous plates 130 may perform a function of controlling cyclic change of dynamic pressures due to a density difference between gaseous refrigerant and liquid refrigerant introduced into the gas-liquid separator 100. In more detail, the plurality of porous plates 130 may lower dynamic pressures of gaseous refrigerant and liquid refrigerant, and thus, may facilitate control of two-phase refrigerant flow. That is, when gaseous refrigerant and liquid refrigerant having different velocities introduced into the gas-liquid separator 100 through the refrigerant inlet 110 collide with the plurality of porous plates 130, the velocities thereof may be lowered and dynamic pressures thereof may be changed to a regular or more desirable value.

The gas-liquid separator 110 including the plurality of porous plates 130 may control two-phase flow through the plurality of porous plates 130, even if refrigerant flow becomes unstable due to a change in a driving condition, and thus, uniformly distribute refrigerant. Further, when the refrigerant mixture of gaseous refrigerant and liquid refrigerant introduced into the refrigerant inlet 110 collides with the plurality of porous plates 130, the velocity thereof may be lowered, and thus, stable gas-liquid separation of the refrigerant mixture into the gaseous refrigerant and the liquid refrigerant may be achieved.

A number of the plurality of porous plates 130 provided in the housing 120, installation positions of the plurality of porous plates 130, and porosity of the plurality of porous plates 130 may be main factors determining velocity control of two-phase refrigerant and a stable gas-liquid separation area.

As exemplarily shown in FIG. 5, the distributor 200 may include a first refrigerant distributor 210 provided with a plurality of first through holes 220 formed to extend in a widthwise direction W to distribute refrigerant in the widthwise direction W. Further, the distributor 200 may include a second refrigerant distributor 230 provided with a plurality of second through holes 240 formed in a lengthwise direction L to distribute refrigerant in the lengthwise direction L.

The second refrigerant distributor 230 may re-distribute refrigerant in the lengthwise direction through the plurality of second through holes 240, and then, drop or direct the refrigerant to the heat transfer pipe 22. Further, in order to drop or direct the refrigerant to the heat transfer pipe 22, the second refrigerant distributor 230 may include a plurality of refrigerant dropping devices 250 having a sectional area of flow surfaces thereof that decreases in a flow direction of the refrigerant.

In order to more uniformly distribute the refrigerant, each of the plurality of refrigerant dropping devices 250 may include a refrigerant storage that stores the refrigerant dropped or received from the plurality of second through holes 240, and a plurality of slits formed at a lower portion the refrigerant storage.

Hereinafter, a distributor according to embodiments will be described in further detail with reference to the accompanying drawings.

Figure 6:
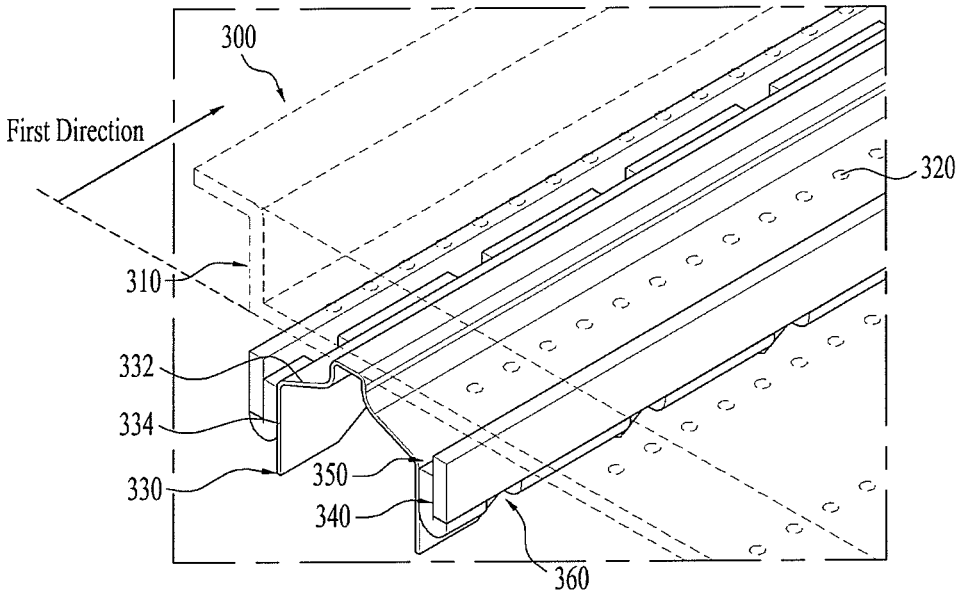
FIGS. 6 and 7 are views of a distributor in accordance with an embodiment.
Figure 7:
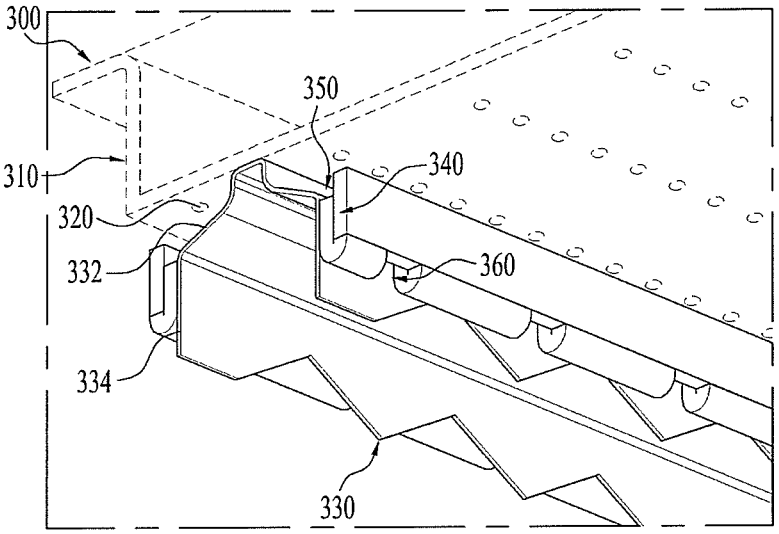

FIGS. 6 and 7 are views of a distributor in accordance with an embodiment. A distributor 300 in accordance with this embodiment may be formed integrally with gas-liquid separator 100, or may be formed separately from the gas-liquid separator 100 and provided under the gas-liquid separator 100.

The distributor 300 may include a first refrigerant distributor 310 provided with a plurality of through holes 320 formed in a first direction (hereinafter, referred to as "the lengthwise direction"). The distributor 300 may further include a plurality of refrigerant dropping devices 330 that guide refrigerant dropped through the plurality of through holes 320 to the heat transfer pipe 22 and having a sectional area of flow surfaces thereof that decreases in a flow direction of the refrigerant.

The plurality of refrigerant dropping devices 330 may be located on or at a lower surface of the first refrigerant distributor 310, and may be combined with the first refrigerant distributor 310 in a mechanical combination manner, such as by spot welding or bolt fastening, for example.

Each refrigerant dropping device 330 may include first areas 332, in which the refrigerant dropped from the plurality of through holes 320 may flow, and second areas 334, a sectional area of flow surfaces of which may decrease in the flow direction of the refrigerant so as to drop the refrigerant having flowed along on the first areas 332 to the heat transfer pipe 22.

The first areas 332 may form curved surfaces, and the second areas 334 may form planar surfaces. The first areas 332 and the second areas 334 may be connected at a predetermined angle, and a boundary, at which the first area 332 and the second area 334 are connected, may form a curved surface. The second areas 334 may be extend in substantially a same direction as a direction of gravity, so that refrigerant may drop substantially vertically from the plurality of refrigerant dropping devices 330. That is, the first area 332 and the second area 334 may be connected at an angle of about 90 degrees or more.

The distributor 300 may further include a plurality of second refrigerant distributors 340 that guide uniform dropping of the refrigerant, dropped through the plurality of through holes 320 of the first refrigerant distributor 310, to the heat transfer pipe 22. Each second refrigerant distributor 340 may be provided on a flow surface of a refrigerant dropping device 330 and may include a refrigerant storage 350 that stores refrigerant dropped from the plurality of through holes 320 and then flowing along the flow surface of the refrigerant dropping device 330. Further, each second refrigerant distributor 340 may be provided with a plurality of slits formed at a lower portion of the refrigerant storage 350 that guide the refrigerant stored in the refrigerant storage 350 to the refrigerant dropping device 330.

The plurality of second refrigerant distributors 340 may extend in the first direction, and the plurality of slits 360 may be separated from each other by a designated interval in the first direction. The plurality of slits 360 may be openings having a same width, and thus, amounts of refrigerant having passed through the plurality of slits 360 may be uniform in the first direction. Thereby, the amounts of refrigerant distributed to the heat transfer pipe 22 may be uniform in the first direction.

Each refrigerant dropping device 330 may be provided in a shape in which the sectional area of the flow surfaces thereof decreases in the flow direction of the refrigerant, and refrigerant having passed through the plurality of slits 360 may drop from ends of the refrigerant dropping device 330 having a smallest sectional area to the heat transfer pipe 22.

As described above, refrigerant dropped from the first refrigerant distributor 310 may be temporarily stored in the refrigerant storages 350 of the second refrigerant distributors 340. At this time, most of the kinetic energy of the refrigerant may be lost.

The refrigerant having lost kinetic energy may pass through the plurality of slits 360 formed at the lower ends of the refrigerant storages 350, and then, may be guided to the ends of the refrigerant dropping devices 330 by surface tension on the flow surfaces of the refrigerant dropping devices 330 and gravity. The refrigerant may drop from the ends of the refrigerant dropping devices 330 having the smallest sectional area of the flow surfaces thereof to the heat transfer pipe 22 by gravity.

Each second refrigerant distributor 340 may be provided in the second area 334 of the refrigerant dropping device 330. The reason for this is that refrigerant rapidly moves from the boundary, at which the first area 332 and the second area 334 are connected, to the second area 334 having a greater gradient than the first area 332 after flowing in the first area 332, and thus, may be easily stored in the refrigerant storage 350.

Each refrigerant storage 350 may have a greater height than a start point of the curved surface of the boundary, at which the first area 332 and the second area 334 are connected. That is, each refrigerant storage 350 may extend from the boundary to a designated height toward the first refrigerant distributor 310. This may serve to form a space to store the refrigerant in the refrigerant storage 350.

The refrigerant storage 350 may have a hollow cylindrical or polyhedral shape, an upper surface of which may be open, so as to easily store a liquid flowing in a downward direction. The downward flow direction of the liquid may be substantially the same as the direction of gravity. One surface of each refrigerant storage 350 may be combined with the second area 334 so as to store the refrigerant flowing from the first area 332 and introduced into the second area 334 of the plurality of refrigerant dropping devices 330.

The plurality of slits 360 of each second refrigerant distributor 340 may be formed at a lower portion of the refrigerant storage 350. An opening formed at one side of each of the plurality of slits 360 may contact the second area 334 of the refrigerant dropping device 330.

The plurality of slits 360 may be through holes formed adjacent to the plurality of refrigerant dropping devices 330. The plurality of slits 360 may be formed on a coaxial line with ends of the plurality of refrigerant dropping devices 330 having the smallest sectional area of the flow surfaces thereof. The refrigerant having passed through the plurality of slits 360 may rectilinearly flow on lower flow surfaces of the plurality of refrigerant dropping devices 330 and be guided to the ends of the plurality of refrigerant dropping devices 330.

Otherwise, the plurality of slits 360 may be located between two neighboring refrigerant dropping devices 330. The refrigerant having passed through the plurality of slits 360 may be guided to the ends of the plurality of refrigerant dropping devices 330 along sides of the flow surfaces of the plurality of refrigerant dropping devices 330 having the sectional area of the flow surfaces thereof that decreases in the flow direction of the refrigerant. The sides of the flow surfaces may be inclined by a predetermined angle so that the sectional area of the flow surfaces of the plurality of refrigerant dropping devices 330 decreases in the flow direction of the refrigerant.

The plurality of refrigerant dropping devices 330 may be formed in a structure, the sectional area of which decreases in the flow direction of the refrigerant and which has a sharpened end, and a plurality of these refrigerant dropping devices 330 may be connected. For example, the plurality of refrigerant dropping devices 330 may be formed in a saw-toothed shape. The sharpened ends of the plurality of refrigerant dropping devices 330 may be located corresponding to the heat transfer pipe 22, to which the refrigerant will be dropped. Further, a number of the sharpened refrigerant dropping devices 330 may be designed in consideration of a pitch by which dry spots are not generated in the heat transfer pipe 22.

The plurality of refrigerant dropping devices 330 having the above structure drop the refrigerant correctly to the heat transfer pipe 22, and thus, may reduce an amount of liquid refrigerant which does not contact the heat transfer pipe 22 and is eliminated.

Figure 8:
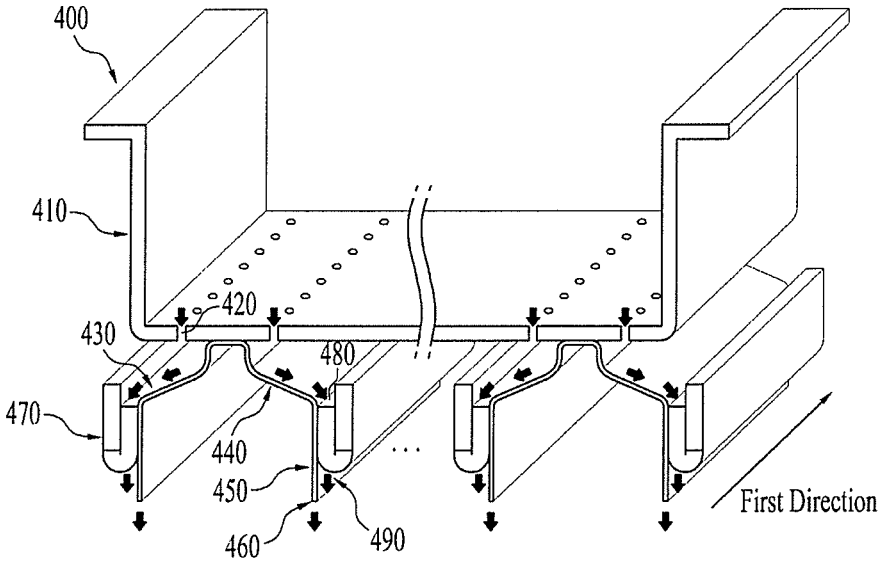
FIG. 8 is an enlarged front view of a distributor in accordance with another embodiment.

FIG. 8 is an enlarged front view of a distributor in accordance with another embodiment. With reference to FIG. 8, structure of a distributor in accordance with embodiments will be described in detail.

A distributor 400 according to this embodiment may include a first member 410 provided with a plurality of through holes 420 formed to extend in a first direction. The first direction may be the same as a lengthwise direction of heat transfer pipe 22 provided within evaporator 20.

Further, the distributor 400 may further include a plurality of second members 430 including a plurality of refrigerant dropping devices 460 connected to the first member 410, to guide refrigerant introduced through the plurality of through holes 420 to the heat transfer pipe 22, and having a sectional area of flow surfaces thereof that decreases in a flow direction of the refrigerant. The plurality of second members 430 may be located under a lower surface of the first member 410, and may be combined with the first member 410 in a mechanical combination manner, such as by spot welding or bolt fastening, for example.

The plurality of second member 430 may include first areas 440, in which the refrigerant dropped from the plurality of through holes 420 may flow, and second areas 450 that extend from the first areas 440 in the flow direction of the refrigerant. A plurality of refrigerant dropping devices 460 may be provided in the second areas 450.

The first areas 440 may form curved surfaces, and the second areas 450 may form planar surfaces. The first areas 440 and the second areas 450 may be connected at a predetermined angle, and a boundary, at which the first area 440 and the second area 450 are connected, may form a curved surface.

The second areas 450 may be formed to extend in a same direction as the direction of gravity, so that refrigerant may drop vertically from the plurality of refrigerant dropping devices 460. That is, the first areas 440 and the second areas 450 may be connected at an angle of about 90 degrees or more.

The distributor 400 may further include a plurality of third members 470, each of which may include a refrigerant storage 480 that stores the refrigerant dropped from the plurality of through holes 420 and flowing in the first area 440, and a plurality of slits 490 formed at a lower portion of the refrigerant storage 480. The plurality of third members 470 may extend to a same length as the plurality of second members 430, that is, in the first direction. Otherwise, a plurality of third members 470 may be formed on the second member 430 in the first direction.

The plurality of third members 470 may be located in the second areas 450 of the plurality of second members 430. More particularly, the refrigerant storage 480 may be formed at an end point of the boundary at which the first area 440 and the second area 450 of the second member 430 are connected via a curved surface. The reason for this is that the refrigerant rapidly moves from the boundary to the second area 450 having a greater gradient than the first area 440 after flowing in the first area 440, and thus, is easily stored in the refrigerant storage 480.

Each refrigerant storage 480 may have a greater height than a start point of the boundary. That is, each refrigerant storage 480 may extend from the boundary to a designated height toward the first member 410. This may serve to form a space that stores the refrigerant in the refrigerant storage 480.

Each refrigerant storage 480 may have a hollow cylindrical or polyhedral shape, an upper surface of which may be open, so as to easily store a liquid flowing in a downward direction. A downward flow direction of the liquid may be substantially the same as the direction of gravity.

One surface of each refrigerant storage 480 may be combined with a respective second area 450 so as to store the refrigerant flowing from a respective second member 430.

A plurality of slits 490 of each third member 470 may be formed at a lower portion of the refrigerant storage 480. An opening formed at one side of each of the plurality of slits 490 may contact the respective second area 450 of the respective second member 430. The plurality of slits 490 may be through holes formed adjacent to the plurality of refrigerant dropping devices 460.

The plurality of slits 490 of each third member 470 may be formed on a coaxial line with ends of the plurality of refrigerant dropping devices 460 having a smallest sectional area of the flow surfaces thereof. Otherwise, the plurality of slits 490 may be located between neighboring refrigerant dropping devices 460, so that the refrigerant flows along sides of the flow surfaces of the plurality of refrigerant dropping devices 460 having the sectional area of the flow surfaces thereof that decreases in the flow direction of the refrigerant. The sides of the flow surfaces may be inclined having a predetermined angle so that the sectional area of the flow surfaces of the plurality of refrigerant dropping devices 460 decreases in the flow direction of the refrigerant.

The plurality of second members 430 may be formed in a shape which is symmetrical with respect to a second direction perpendicular to the first direction with respect to a central line. The second direction may be substantially the same as the direction of gravity.

Figure 9:
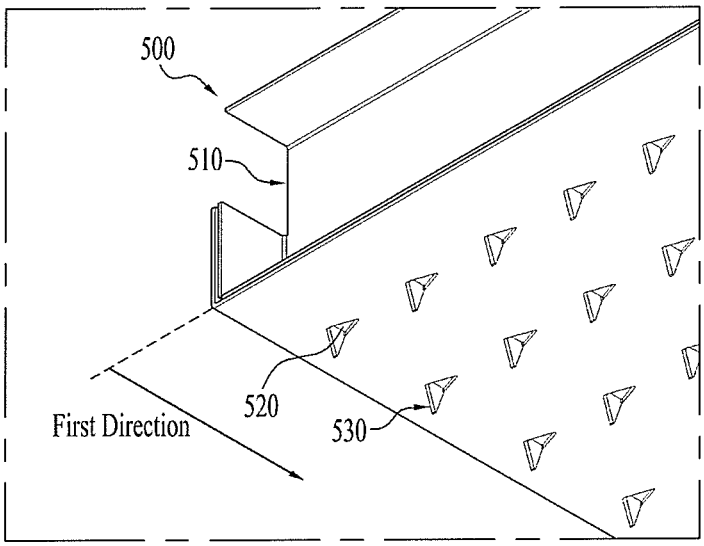
FIG. 9 is a perspective view of a distributor illustrating a modification to second members in accordance with embodiments.

FIG. 9 is a perspective view of a distributor illustrating a modification of second members in accordance with embodiments. As exemplarily shown in FIG. 9, distributor 500 may be configured such that a first member 510 provided with a first through hole formed in the first direction and second members 530, a sectional area of flow surfaces thereof which decreases in a flow direction of the refrigerant, may be formed integrally. The first direction may be substantially the same as a lengthwise direction of the heat transfer pipe 22 provided within the evaporator 20.

The second members 530 may be formed by partially cutting a lower surface of the first member 510 to form a plurality of through holes 520 and then bending the cut portions. Otherwise, the second members 530 may be formed separately from the first member 510, and then, may be combined with the lower surfaces of the plurality of through holes 520. The plurality of through holes 520 of the first member 510 and the second members 530 may be formed in different shapes.

Hereinafter, a distributor in accordance with another embodiment of will be described with reference to FIGS. 10 to 13.

Figure 10:
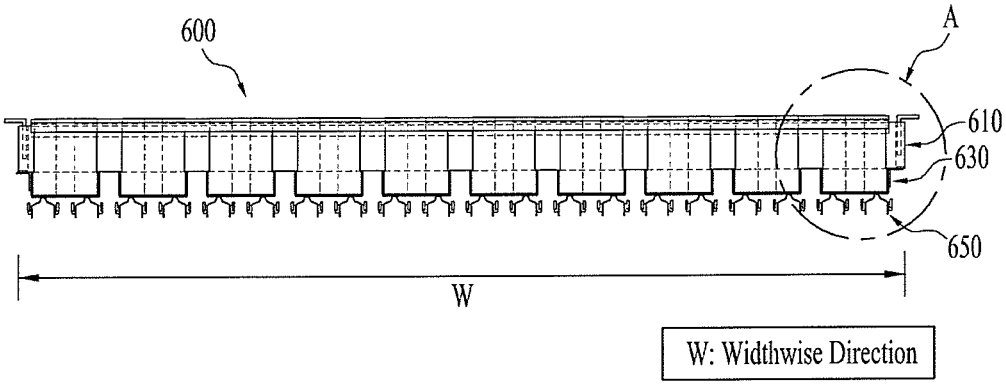
FIG. 10 is a front view of a distributor in accordance with another embodiment.
Figure 11:
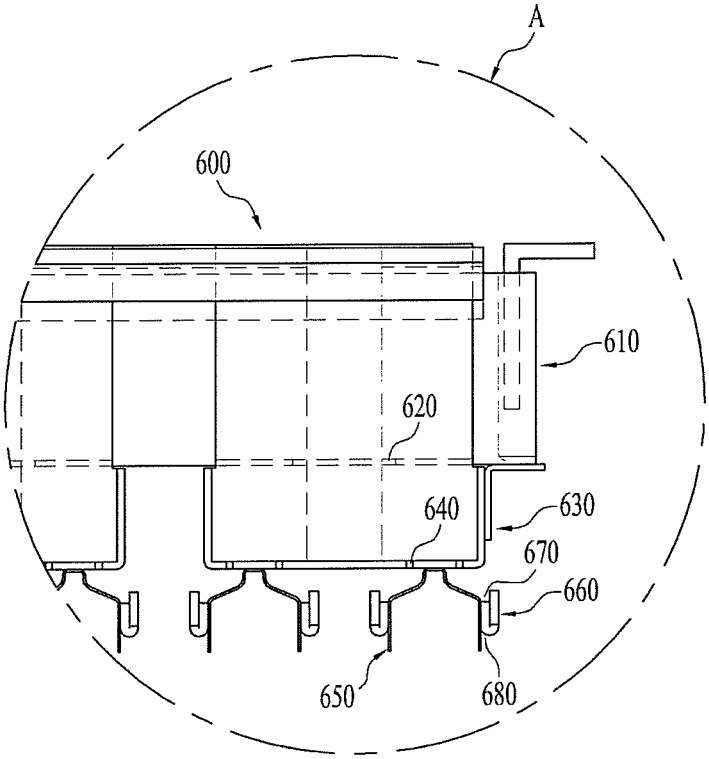
FIG. 11 is an enlarged view of portion "A" of the distributor of FIG. 10.
Figure 12:
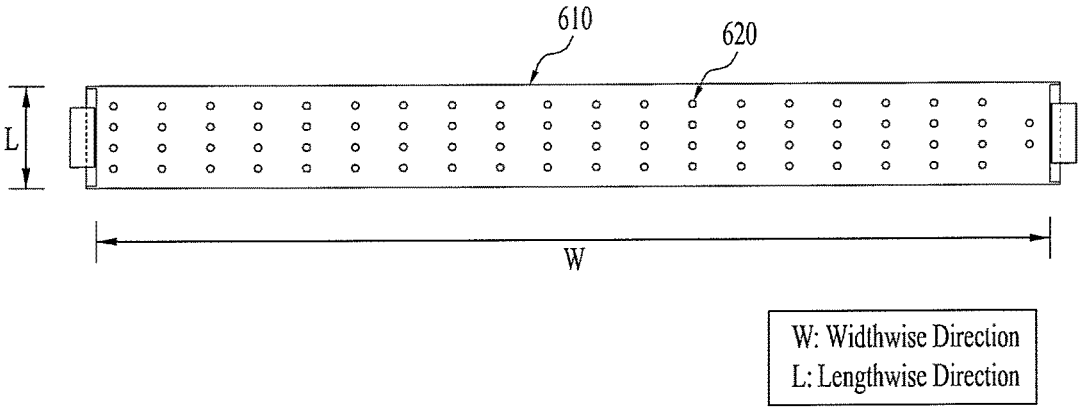
FIG. 12 is a plan view illustrating a first refrigerant distributor of the distributor in accordance with embodiments.
Figure 13:
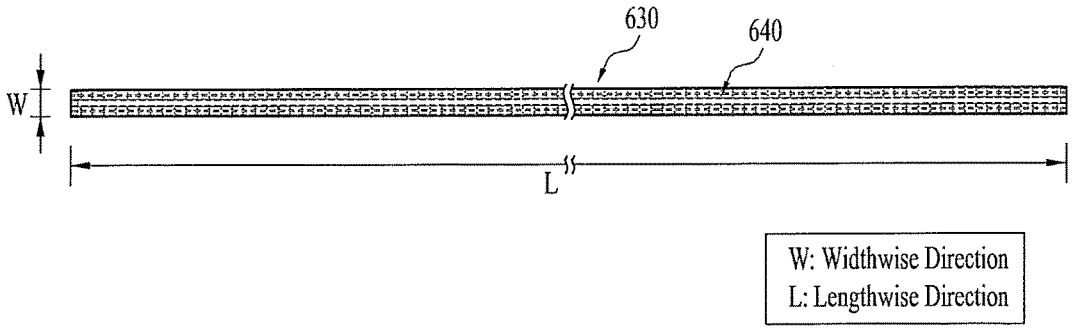
FIG. 13 is a plan view illustrating a second refrigerant distributor of the distributor in accordance with embodiments.

FIG. 10 is a front view of a distributor in accordance with another embodiment. FIG. 11 is an enlarged view of portion "A" of the distributor of FIG. 10. FIG. 12 is a plan view illustrating a first refrigerant distributor of the distributor in accordance with embodiments. FIG. 13 is a plan view illustrating a second refrigerant distributor of the distributor in accordance with embodiments.

A distributor 600 in accordance with this embodiment may be formed integrally with gas-liquid separator 100, or may be formed separately and then provided under the gas-liquid separator 100. The distributor 600 may include a plurality of first refrigerant distributors 610 provided with a plurality of first through holes 620 formed in a widthwise direction W of the gas-liquid separator 100 to distribute refrigerant in the widthwise direction of the heat transfer pipe 22.

Further, a plurality of second refrigerant distributors 630 to re-distribute refrigerant, transmitted from the first refrigerant distributor 610, in a lengthwise direction L of the heat transfer pipe 22, may be provided under the plurality of first distributors 610. A plurality of second through holes 640 may be formed on each of the plurality of second refrigerant distributors 630 in the lengthwise direction L, so as to distribute the refrigerant in the lengthwise direction of the heat transfer pipe 22.

The gas-liquid separator 100 and the distributor 600 may extend so as to correspond to a length and width of the heat transfer pipe 22 located thereunder. Thereby, the distributor 600 may uniformly distribute the refrigerant in the lengthwise direction and widthwise direction of the heat transfer pipe 22.

The plurality of second refrigerant distributors 630 located under the plurality of first refrigerant distributors 610 may substantially perpendicularly cross the plurality of first refrigerant distributors 610. The plurality of second refrigerant distributors 630 may each include a plurality of refrigerant dropping devices 650 that guide the refrigerant introduced through the plurality of second through holes 640 in the lengthwise direction of the heat transfer pipe 22. The plurality of refrigerant dropping devices 650 may be provided in a shape in which a sectional area of flow surfaces thereof decreases in a flow direction of the refrigerant.

The plurality of first refrigerant distributors 610 may be installed under the gas-liquid separator 100 and extend more in the widthwise direction W than the lengthwise direction L, so as to distribute the refrigerant transmitted from the gas-liquid separator 100 in the widthwise direction of the gas-liquid separator 100. The plurality of first refrigerant distributors 610 may each have a same width, that is, a same horizontal length, as the gas-liquid separator 100.

The plurality of first refrigerant distributors 610 separated from each other by a designated interval in the lengthwise direction of the gas-liquid separator 100 may be formed on a lower surface of the gas-liquid separator 100. The plurality of first refrigerant distributors 610 may each be formed in a polyhedral shape having a designated height, an upper surface of which is open, so as to receive refrigerant.

The plurality of first through holes 620 may be formed on a lower surface of each of the plurality of first refrigerant distributors 610 so as to transmit the refrigerant to the plurality of second refrigerant distributors 630. That is, the refrigerant dropped from the gas-liquid separator 100 may be distributed in the widthwise direction by the plurality of first refrigerant distributors 610 and may be dropped to the plurality of second refrigerant distributors 630 through the plurality of first through holes 620.

The plurality of second refrigerant distributors 630 may be installed under the plurality of first refrigerant distributors 610 and may extend more in the lengthwise direction L than the widthwise direction W, so as to distribute the refrigerant transmitted from the plurality of first refrigerant distributors 610 in the lengthwise direction. The plurality of second refrigerant distributors 630 may have a same vertical length as the gas-liquid separator 100.

The plurality of second refrigerant distributors 630 separated from each other by a designated interval in the widthwise direction of the gas-liquid separator 100 may be formed on the lower surfaces of the plurality of first refrigerant distributors 610. The plurality of second refrigerant distributors 630 may each be formed in a polyhedral shape having a designated height, an upper surface of which is open, so as to receive refrigerant.

The plurality of second through holes 640 may be formed on lower surfaces of the plurality of second refrigerant distributors 640 so as to drop the refrigerant to the heat transfer pipe 22. The plurality of first through holes 620 and the plurality of second through holes 640 may be designed such that numbers and sizes of the plurality of first through holes 620 and the plurality of second through holes 640 may be determined according to a flow rate of the refrigerant dropped to the heat transfer pipe 22, and heights of refrigerant stored in the plurality of first refrigerant distributors 610 and the plurality of second refrigerant distributors 630.

The plurality of refrigerant dropping devices 650 that guide the refrigerant dropped through the plurality of second through holes 640 to the heat transfer pipe 22 in the lengthwise direction of the gas-liquid separator 100 may be provided under the plurality of second refrigerant distributors 630. The plurality of refrigerant dropping devices 650 may be formed in a shape in which a sectional area of flow surfaces thereof decreases in a flow direction of the refrigerant. That is, the refrigerant distributed in the widthwise direction by the plurality of first refrigerant distributors 610 may be distributed in the lengthwise direction by the plurality of second refrigerant distributors 630, and then, may be transmitted to the plurality of refrigerant dropping devices 650 formed in the lengthwise direction through the plurality of second through holes 640, and thus, be re-distributed in the lengthwise direction and dropped to the heat transfer pipe 22.

The distributor 600 may further include a plurality of third refrigerant distributors 660 provided on flow surfaces of the plurality of refrigerant dropping devices 650. The plurality of third refrigerant distributors 660 may include a refrigerant storage 670 to store refrigerant dropped from the plurality of second through holes 640, and a plurality of slits 680 formed at a lower portion of the refrigerant storage 670.

The plurality of slits 680 may be provided between the plurality of second refrigerant distributors 630 and the plurality of refrigerant dropping devices 650, and may guide the refrigerant having passed through the plurality of second through holes 640 to the refrigerant dropping device 650. The plurality of slits 680 may be openings having a same width, and thus, amounts of refrigerant having passed through the plurality of slits 680 may be uniform in the first direction. Thereby, amounts of refrigerant distributed to the heat transfer pipe 22 may be uniform in the first direction.

The plurality of refrigerant dropping devices 650 may be provided in a shape in which a sectional area of the flow surfaces thereof decreases in the flow direction of the refrigerant, and refrigerant having passed through the plurality of slits 680 may drop from ends of the plurality of refrigerant dropping devices 650 having a smallest sectional area to the heat transfer pipe 22.

As described above, refrigerant dropped from the plurality of first refrigerant distribution devices 610 may be temporarily stored in the plurality of refrigerant storages 670 of the plurality of second refrigerant distributors 630. At this time, most of the kinetic energy of the refrigerant may be lost. The refrigerant having lost kinetic energy may pass through the plurality of slits 680 formed at lower portions of the storages 670, and then, may be guided to ends of the plurality of refrigerant dropping devices 650 by surface tension on the flow surfaces of the plurality of refrigerant dropping devices 650 and gravity. The refrigerant may drop from the ends of the plurality of refrigerant dropping devices 650 having the smallest sectional area of the flow surfaces thereof to the heat transfer pipe 22 by gravity.

The plurality of slits 680 may be formed on a coaxial line with the ends of the plurality of refrigerant dropping devices 650 having the smallest sectional area of the flow surfaces thereof. The refrigerant having passed through the plurality of slits 680 may rectilinearly flow on the lower flow surfaces of the plurality of refrigerant dropping devices 650 and be guided to the ends of the plurality of refrigerant dropping devices 650. Otherwise, the plurality of slits 680 may be located between two neighboring refrigerant dropping devices 650. The refrigerant having passed through the plurality of slits 680 may be guided to the ends of the plurality of refrigerant dropping devices 650 along sides of the flow surfaces of the refrigerant dropping devices 650, which may be inclined by a predetermined angle, so that the sectional area of the flow surfaces of the plurality of refrigerant dropping devices 650 decreases in the flow direction of the refrigerant.

The plurality of refrigerant dropping devices 650 may be formed in a structure, the sectional area of which decreases in the flow direction of the refrigerant and which has a sharpened end, and a plurality of these refrigerant dropping devices 650 may be connected. For example, the plurality of refrigerant dropping devices 650 may be formed in a saw-toothed shape. The sharpened ends of the plurality of refrigerant dropping devices 650 may be located corresponding to the heat transfer pipe 22, to which the refrigerant will be dropped. Further, a number of the sharpened refrigerant dropping devices 650 may be designed in consideration of a pitch by which dry spots are not generated in the heat transfer pipe 22.

These structured refrigerant dropping devices 650 may uniformly distribute the refrigerant to the heat transfer pipe 22 and drop the refrigerant correctly to the heat transfer pipe 22, and thus, may reduce an amount of liquid refrigerant which does not contact the heat transfer pipe 22.

As apparent from the above description, a distributor and a turbo refrigerating machine and evaporator having the same in accordance with embodiments may uniformly distribute refrigerant to a heat transfer pipe, and thus, may improve heat exchange efficiency.

The distributor and the turbo refrigerating machine and evaporator having the same in accordance with embodiments may uniformly distribute refrigerant to the heat transfer pipe in a lengthwise direction as well as in a widthwise direction.

Further, the distributor and the turbo refrigerating machine and evaporator in accordance with embodiments lower dynamic pressures of gaseous refrigerant and liquid refrigerant introduced into the evaporator, and thus, may effectively control two-phase flow. Furthermore, the distributor and the turbo refrigerating machine and evaporator in accordance with the embodiments may effectively separate gaseous refrigerant and liquid refrigerant introduced into the evaporator from each other, and thus, may cause the liquid refrigerant alone to be introduced into the distributor and then uniformly distributed.

Also, the distributor and the turbo refrigerating machine and evaporator in accordance with the embodiments may prevent liquid refrigerant from being introduced into a compressor by a gas-liquid separator provided with an eliminator. Additionally, the distributor and the turbo refrigerating machine and evaporator in accordance with embodiments may distribute the refrigerant correctly to a position of a heat transfer pipe to which the refrigerant is to be dropped, and thus, increase heat exchange efficiency.

Embodiments disclosed herein provide a distributor, which may uniformly distribute refrigerant to a heat transfer pipe to improve heat exchange efficiency, and turbo refrigerating machine and evaporator having the same.

Embodiments disclosed herein further provide an evaporator having a distributor, which may lower dynamic pressures of gaseous refrigerant and liquid refrigerant introduced into an evaporator to easily control two-phase flow.

Embodiments disclosed herein additionally provide an evaporator having distributor, which may effectively separate gaseous refrigerant and liquid refrigerant.

Embodiments disclosed herein also provide an evaporator having a distributor with which a gas-liquid separator supply liquid refrigerant alone to the distributor to uniformly distribute the refrigerant is integrated.

Embodiments disclosed herein provide an evaporator for use in a turbo refrigerating machine that may include a shell that forms an external appearance of the evaporator; a gas-liquid separator unit or separator formed within the shell, that separates gaseous refrigerant and liquid refrigerant from a refrigerant mixture introduced through a refrigerant inlet, and provided with an eliminator; a distributor unit or distributor formed under the gas-liquid separator unit and provided with a plurality of refrigerant dropping units or devices formed at a lower portion thereof so as to uniformly distribute the liquid refrigerant introduced from the gas-liquid separator unit; and a heat transfer pipe provided under the distributor unit to provide heat exchange between the liquid refrigerant distributed by the distributor unit and chilled water in the heat transfer pipe. The distributor unit may include a first refrigerant distribution unit or distributor provided with a plurality of through holes formed in a first direction. The plurality of refrigerant dropping units may guide liquid refrigerant, dropped from the first refrigerant distribution unit through the plurality of through holes, to a heat transfer pipe and having a sectional area of flow surfaces thereof which decreases in the flow direction of the liquid refrigerant.

The distributor unit may further include second refrigerant distribution units or distributors provided on flow surfaces of the plurality of refrigerant dropping units. Each of the second refrigerant distribution units may include a refrigerant storage unit or storage that temporarily stores the liquid refrigerant dropped from the plurality of through holes and a plurality of slits formed at a lower portion of the refrigerant storage unit. The plurality of slits may be provided between the first refrigerant distribution unit and the plurality of refrigerant dropping units and adapted to guide the liquid refrigerant having passed through the plurality of through holes to the plurality of refrigerant dropping units. Each of the plurality of slits may be aligned with an end having a smallest sectional area of the flow surfaces of a corresponding one of the plurality of refrigerant dropping units, an axis of alignment lying in a vertical plane. Each of the plurality of slits may be located between two neighboring refrigerant dropping units and guides flow of the liquid refrigerant along side parts of the plurality of the refrigerant dropping units, which may be inclined by a designated angle so that a sectional area of the flow surfaces of the plurality of refrigerant dropping units decreases in the flow direction of the liquid refrigerant.

The plurality of refrigerant dropping units may be formed in a saw-toothed shape. Each of the plurality of refrigerant dropping units may include first areas, in which the liquid refrigerant dropped from the plurality of through holes of the first refrigerant distribution unit may flow, and second areas, which may extend downward from the first areas. The sectional area of flow surfaces of the second areas may decrease in the flow direction of the liquid refrigerant so as to drop the liquid refrigerant to the heat transfer pipe.

The first areas may form curved surfaces and the second areas may form planar surfaces. The first area and the second area may be connected at a designated angle, and a boundary part or boundary between the first area and the second area may form a curved surface.

The evaporator may further include a refrigerant storage unit or storage that store the liquid refrigerant dropped from the plurality of through holes, and a plurality of slits formed at the lower portion of the refrigerant storage unit provided in the second area. Each of the plurality of refrigerant dropping units may be located at an edge of a corresponding one of the plurality of through holes. The refrigerant dropping units each may have a pointed tip. Part of the liquid refrigerant distributed by the distributor unit may be carried to a bottom of the shell and a part of the heat transfer pipe may be submerged in a pool formed at the bottom of the shell.

The gas-liquid separator unit or separator may include a housing including porous plates that separates gaseous refrigerant and liquid refrigerant from a refrigerant mixture introduced through the refrigerant inlet; a gaseous refrigerant outlet, through which the separated gaseous refrigerant may be discharged from the gas-liquid separator unit, and a liquid refrigerant outlet, through which the separated liquid refrigerant may be discharged from the gas-liquid separator unit; and the eliminator may be provided at the gaseous refrigerant outlet. The eliminator may be located above the gaseous refrigerant outlet.

The porous plates may be provided in a plural number within the housing and may be separated from each other by a designated interval in a length or lengthwise direction of the housing.

Embodiments disclosed herein may further provide a distributor unit or distributor that may include a first member provided with a plurality of through holes formed in a first direction, and second members including a plurality of refrigerant dropping units or devices. The plurality of refrigerant dropping units may be connected to the first member, guide refrigerant introduced through the plurality of through holes to a heat transfer pipe, and have sectional area of flow surfaces thereof that decreases in a flow direction of the refrigerant.

Further, the second member may include first areas, in which the refrigerant dropped from the plurality of through holes may flow, and second areas, which may extend from the first areas in the flow direction of the refrigerant and in which the plurality of refrigerant dropping units may be provided. The distributor unit may further include third members, each of which may include a refrigerant storage unit or storage that stores the refrigerant dropped from the plurality of through holes, and a plurality of slits formed at a lower portion of the refrigerant storage unit.

Embodiments disclosed herein further provide a distributor unit or distributor that may include first refrigerant distribution units or distributor that distribute refrigerant in a width or widthwise direction, and second refrigerant distribution units or distributor that receive the refrigerant transmitted from the first refrigerant distribution units and distribute the refrigerant in a length or lengthwise direction. The first refrigerant distribution units may be provided with a plurality of first through holes formed in a width or widthwise direction so as to distribute refrigerant in the width direction, and the second refrigerant distribution units may be provided with a plurality of second through holes formed in a length or lengthwise direction so as to distribute the refrigerant in the length direction. The plurality of refrigerant dropping units may guide the refrigerant, introduced from the second refrigerant distribution units through the plurality of second through holes, to a heat transfer pipe in the length direction and having a sectional area of flow surfaces thereof that decreases in the flow direction of the refrigerant. The evaporator may be a hybrid falling film evaporator in which a part or portion of the liquid refrigerant distributed by the distributor unit is carried to a bottom of a shell, and a part or portion of the heat transfer pipe is submerged in a pool formed at the bottom of the shell.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An evaporator for use in a turbo refrigerating machine, comprising:

a shell that forms an external appearance of the evaporator;

a gas-liquid separator formed within the shell, that separates gaseous refrigerant and liquid refrigerant from a refrigerant mixture introduced through a refrigerant inlet, and provided with an eliminator;

a distributor disposed under the gas-liquid separator and provided with a plurality of refrigerant dropping devices formed at a lower portion of the distributor so as to uniformly distribute the liquid refrigerant introduced from the gas-liquid separator; and a heat transfer pipe provided under the distributor to provide heat exchange between the liquid refrigerant distributed by the distributor and chilled water in the heat transfer pipe, wherein the distributor includes:

a plurality of first refrigerant distributors provided with a plurality of first through holes formed in a first direction so as to distribute the liquid refrigerant introduced from the gas-liquid separator in the first direction;

a plurality of second refrigerant distributors that receive the liquid refrigerant transmitted from the plurality of first refrigerant distributors and provided with a plurality of second through holes formed in a second direction differing from the first direction so as to distribute the liquid refrigerant introduced from the gas-liquid separator in the second direction; and the plurality of refrigerant dropping devices configured to guide the liquid refrigerant, introduced from the plurality of second refrigerant distributors through the plurality of second through holes, to the heat transfer pipe in the second direction.

2. The evaporator according to claim 1, wherein the gas-liquid separator includes:

a housing including a plurality of porous plates that separates gaseous refrigerant and liquid refrigerant from the refrigerant mixture introduced through the refrigerant inlet;

a gaseous refrigerant outlet, through which the separated gaseous refrigerant is discharged from the gas-liquid separator, a liquid refrigerant outlet, through which the separated liquid refrigerant is discharged from the gas-liquid separator, including a plurality of through holes formed through a lower surface of the housing.

3. The evaporator according to claim 2, wherein the eliminator is located above the gaseous refrigerant outlet.

4. The evaporator according to claim 1, wherein each of the plurality of refrigerant dropping devices includes a refrigerant storage that temporarily stores the liquid refrigerant dropped from the plurality of second through holes, and the refrigerant storage includes a plurality of slits formed at a lower portion of the refrigerant storage.

5. The evaporator according to claim 4, wherein the plurality of slits is adapted to guide the liquid refrigerant having passed through the plurality of through holes to the plurality of refrigerant dropping devices.

6. The evaporator according to claim 5, wherein each of the plurality of slits is aligned with ends having a smallest sectional area of the flow surfaces of a corresponding one of the plurality of refrigerant dropping devices, an axis of alignment lying in a vertical plane.

7. The evaporator according to claim 1, wherein a portion of the liquid refrigerant distributed by the distributor is carried to a bottom of the shell and a portion of the heat transfer pipe is submerged in a pool formed at the bottom of the shell.

8. A turbo refrigerating machine comprising the evaporator of claim 1.

9. The evaporator according to claim 6, wherein each of the plurality of refrigerant dropping devices is formed in a saw-toothed shape.

10. The evaporator according to claim 5, wherein each of the plurality of slits is located between two neighboring refrigerant dropping devices and guides flow of the liquid refrigerant along sides of the plurality of the refrigerant dropping devices, the plurality of the refrigerant dropping devices inclined by a predetermined angle so that the sectional area of the flow surfaces of the plurality of refrigerant dropping devices decreases in the flow direction of the liquid refrigerant.

11. The evaporator according to claim 1, wherein the plurality of refrigerant dropping devices further includes first areas, in which the liquid refrigerant dropped from the plurality of second through holes flows, and second areas that extend from the first areas in the flow direction of the liquid refrigerant.

12. The evaporator according to claim 11, wherein the first areas form curved surfaces and the second areas form planar surfaces.

13. The evaporator according to claim 11, wherein the first areas and the second areas are connected at a predetermined angle, and a boundary between the first areas and the second areas form a curved surface.

14. An evaporator for use in a turbo refrigerating machine, comprising:

a shell that forms an external appearance of the evaporator;

a gas-liquid separator formed within the shell, that separates gaseous refrigerant and liquid refrigerant from a refrigerant mixture introduced through a refrigerant inlet, and provided with an eliminator;

a distributor disposed under the gas-liquid separator and provided with a plurality of refrigerant dropping devices formed at a lower portion of the distributor so as to uniformly distribute the liquid refrigerant introduced from the gas-liquid separator; and a heat transfer pipe provided under the distributor to provide heat exchange between the liquid refrigerant distributed by the distributor and chilled water in the heat transfer pipe, wherein the distributor includes:

a plurality of first refrigerant distributors provided with a plurality of first through holes formed in a first direction so as to distribute the liquid refrigerant introduced from the gas-liquid separator in the first direction;

a plurality of second refrigerant distributors that receive the liquid refrigerant transmitted from the plurality of first refrigerant distributors and provided with a plurality of second through holes formed in a second direction differing from the first direction so as to distribute the liquid refrigerant introduced from the gas-liquid separator in the second direction; and the plurality of refrigerant dropping devices configured to guide the liquid refrigerant, introduced from the plurality of second refrigerant distributors through the plurality of second through holes, to the heat transfer pipe in the second direction, the plurality of refrigerant dropping devices having a sectional area of flow surfaces of the plurality of refrigerant dropping devices that decreases in a flow direction of the liquid refrigerant.

15. The evaporator according to claim 14, wherein each of the plurality of refrigerant dropping devices includes a refrigerant storage that temporarily stores the liquid refrigerant dropped from the plurality of second through holes, and the refrigerant storage includes a plurality of slits formed at a lower portion of the refrigerant storage.

16. The evaporator according to claim 15, wherein the plurality of slits is adapted to guide the liquid refrigerant having passed through the plurality of through holes to the plurality of refrigerant dropping devices.

17. The evaporator according to claim 16, wherein each of the plurality of slits is aligned with ends having a smallest sectional area of the flow surfaces of a corresponding one of the plurality of refrigerant dropping devices, an axis of alignment lying in a vertical plane.

18. The evaporator according to claim 17, wherein each of the plurality of refrigerant dropping devices is formed in a saw-toothed shape.

19. The evaporator according to claim 16, wherein each of the plurality of slits is located between two neighboring refrigerant dropping devices and guides flow of the liquid refrigerant along sides of the plurality of the refrigerant dropping devices, the plurality of the refrigerant dropping devices inclined by a predetermined angle so that the sectional area of the flow surfaces of the plurality of refrigerant dropping devices decreases in the flow direction of the liquid refrigerant.

20. The evaporator according to claim 14, wherein the plurality of refrigerant dropping devices further includes first areas, in which the liquid refrigerant dropped from the plurality of second through holes flows, and second areas that extend from the first areas in the flow direction of the liquid refrigerant.

21. The evaporator according to claim 20, wherein the first areas form curved surfaces and the second areas form planar surfaces.

22. The evaporator according to claim 20, wherein the first areas and the second areas are connected at a predetermined angle, and a boundary between the first areas and the second areas form a curved surface.

23. A turbo refrigerating machine comprising the evaporator of claim 14.

* * * * *